US005970673A

United States Patent [19]

Fisher

[11] Patent Number: 5,970,673

[45] Date of Patent: Oct. 26, 1999

[54] CONSTRUCTION BLOCK SYSTEM

[76] Inventor: Myles A. Fisher, 2006 E. Mallory St., Pensacola, Fla. 32503

[21] Appl. No.: 09/048,420

[22] Filed: Mar. 25, 1998

Related U.S. Application Data

[63] Continuation-in-part of application No. 08/603,460, Feb. 20, 1996.

[51] Int. Cl.[6] ..... E04B 5/46; E04C 1/42

[52] U.S. Cl. ..... 52/306; 52/307; 52/308; 52/204.62; 52/235; 52/588.1

[58] Field of Search ..... 52/306, 307, 308, 52/235, 204.61, 204.62, 574, 779, 780, 588.1

[56] References Cited

U.S. PATENT DOCUMENTS

| | | | |
|---|---|---|---|
| 1,025,406 | 5/1912 | Koenig | 52/591.2 |
| 2,655,032 | 10/1953 | Zagray | 52/591.1 |
| 2,970,218 | 1/1961 | Shaw | 250/517.1 |
| 3,148,477 | 9/1964 | Bjorn et al. | 52/591.2 |
| 3,410,044 | 11/1968 | Moog | 52/309.12 |
| 3,818,656 | 6/1974 | Vigliotti | 52/100 |
| 3,834,100 | 9/1974 | Healey | 52/309.1 |
| 3,905,170 | 9/1975 | Huettemann | 52/591.1 |
| 4,075,808 | 2/1978 | Pearlman | 52/439 |
| 4,258,522 | 3/1981 | Amaral | 52/591.2 |
| 4,566,235 | 1/1986 | Groll | 52/220.2 |
| 4,793,104 | 12/1988 | Hultberg et al. | 52/127.3 |
| 5,033,245 | 7/1991 | Kline | 52/306 |
| 5,038,542 | 8/1991 | Kline | 52/306 |
| 5,588,271 | 12/1996 | Pitchford | 52/306 |
| 5,595,033 | 1/1997 | Frey | 52/306 |
| 5,836,125 | 11/1998 | Regina | 52/306 |
| 5,904,019 | 5/1999 | Kooij et al. | 52/306 |
| 5,910,086 | 6/1999 | Fisher | 52/306 |

*Primary Examiner*—Christopher T. Kent
*Assistant Examiner*—Jennifer I. Thissell
*Attorney, Agent, or Firm*—Peter Loffler

[57] ABSTRACT

A construction block system for constructing construction block structures comprises a first construction block, having a pair of parallel faces joined by four side edges, and a second construction block having a pair of parallel faces joined by four side edges. A first set of spacing flanges extend about the four sides of the first construction block while a second set of spacing flanges extend about the four side edges of the second construction block. Hook receptacles are located along the first set of spacing flanges, the second set of spacing flanges or both, while corresponding hooks are located along the second set of spacing flanges, the first set of spacing flanges, or both and are adapted to be received within a corresponding hook receptacle when the first construction block is interconnected with the second construction block.

23 Claims, 7 Drawing Sheets

20
24
26
28
22
20
10
24
12
20
28
24
26
20
24
20
24

CONSTRUCTION BLOCK SYSTEM

This application is a continuation-in-part of application Ser. No. 08/603,460 filed on Feb. 20, 1996.

BACKGROUND OF THE INVENTION

1. Field of the Invention

The present invention relates to a construction block system for building structures with construction blocks.

2. Background of the Prior Art

Glass and glasslike partition walls are a regular part of modern construction. These walls, which can be either internal or external, are made from transparent or translucent glass, or more often, plastic blocks interfitted to form the wall.

My application Ser. No. 08/603,460 filed on Feb. 20, 1996 identified several drawbacks associated with then-current construction blocks and provided a solution to address these problems. The present construction block system continues to address such solutions and provides additional versatility during the manufacturing and assembling process.

SUMMARY OF THE INVENTION

The construction block system of the present invention is used for constructing construction block structures and comprises a first construction block, having a pair of parallel faces joined by four side edges, and a second construction block having a pair of parallel faces joined by four side edges. A first set of spacing flanges extend about the four sides of the first construction block while a second set of spacing flanges extend about the four side edges of the second construction block. Hook receptacles are located along the first set of spacing flanges, the second set of spacing flanges or both, while corresponding hooks are located along the second set of spacing flanges, the first set of spacing flanges, or both and are adapted to be received within a corresponding hook receptacle when the first construction block is interconnected with the second construction block.

The structure produced from the construction block system of the present invention is built by alternating between first construction block and second construction block both horizontally and vertically. Once built, overlapping flanges can be glued, or welded, ultrasonically or otherwise, to each other and a structural bar can be passed between interconnected blocks for additional structural integrity. The outer faces of the outer flanges can be used as a grout groove.

BRIEF DESCRIPTION OF THE DRAWINGS

Similar reference numerals refer to similar parts throughout the several views of the drawings.

DESCRIPTION OF THE PREFERRED EMBODIMENT

Figure 1:
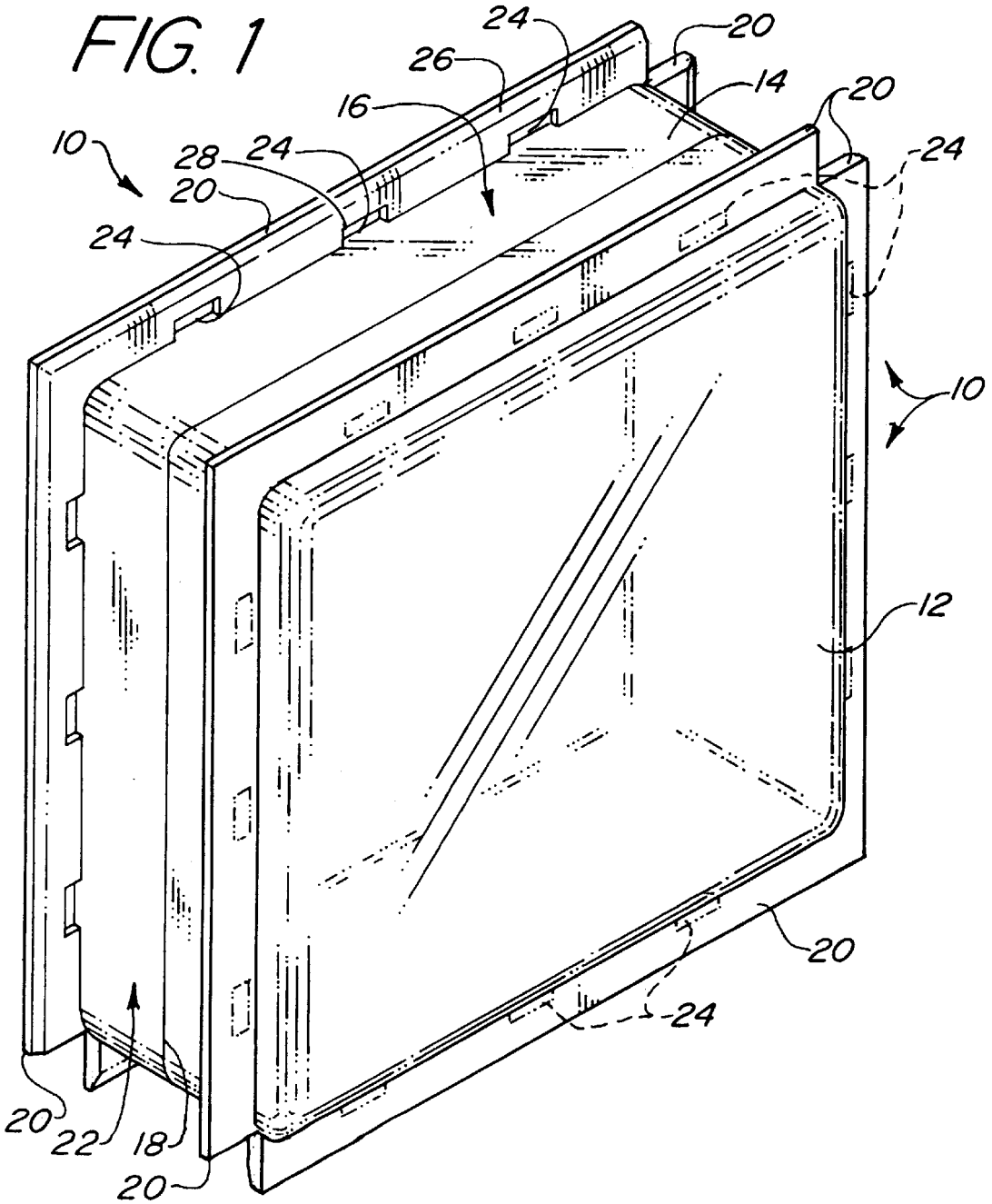
FIG. 1 is a perspective view of the first construction block used with the construction block system of the present invention.
Figure 2:
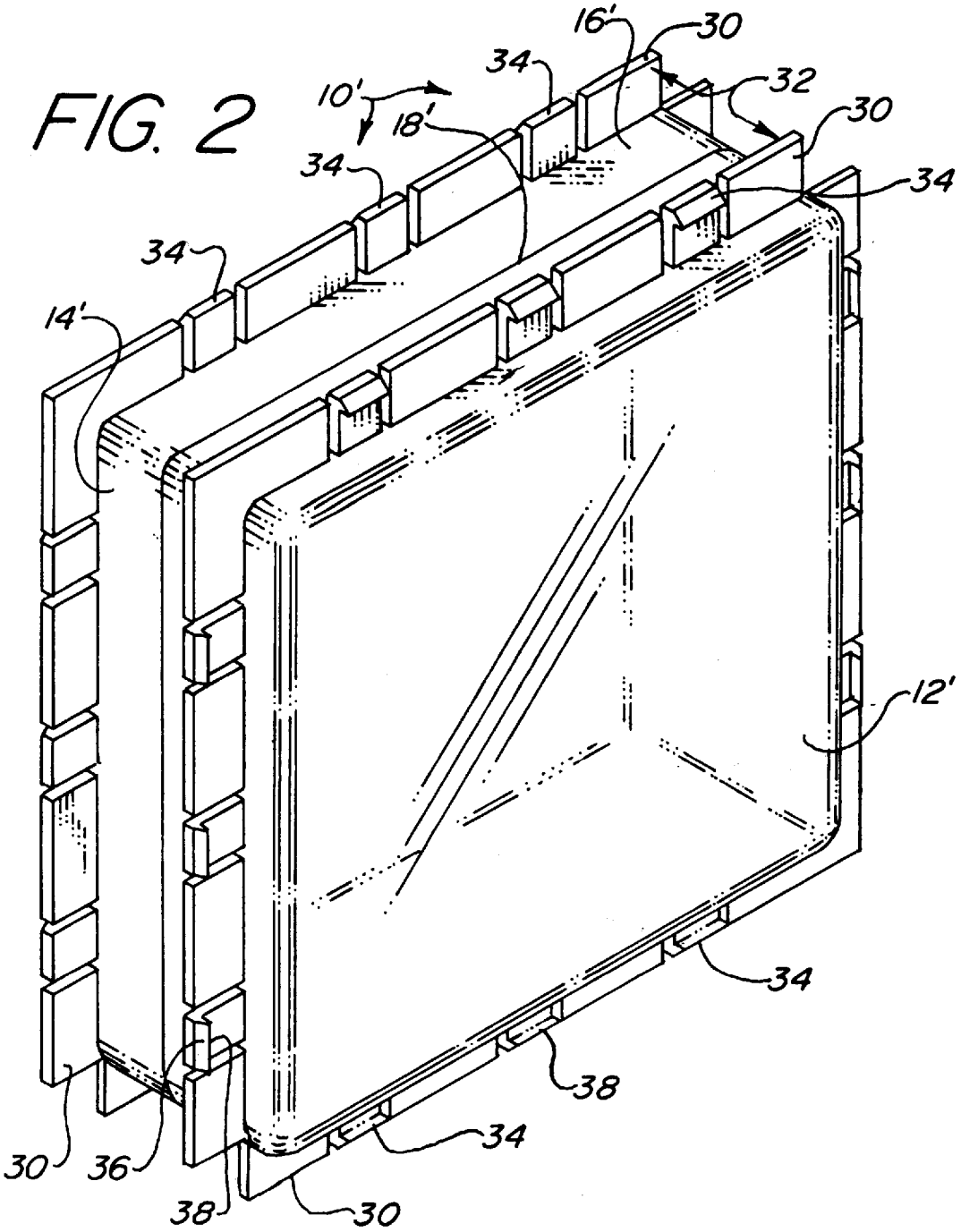
FIG. 2 is a perspective view of the second construction block used with the construction block system of the present invention.
Figure 3:
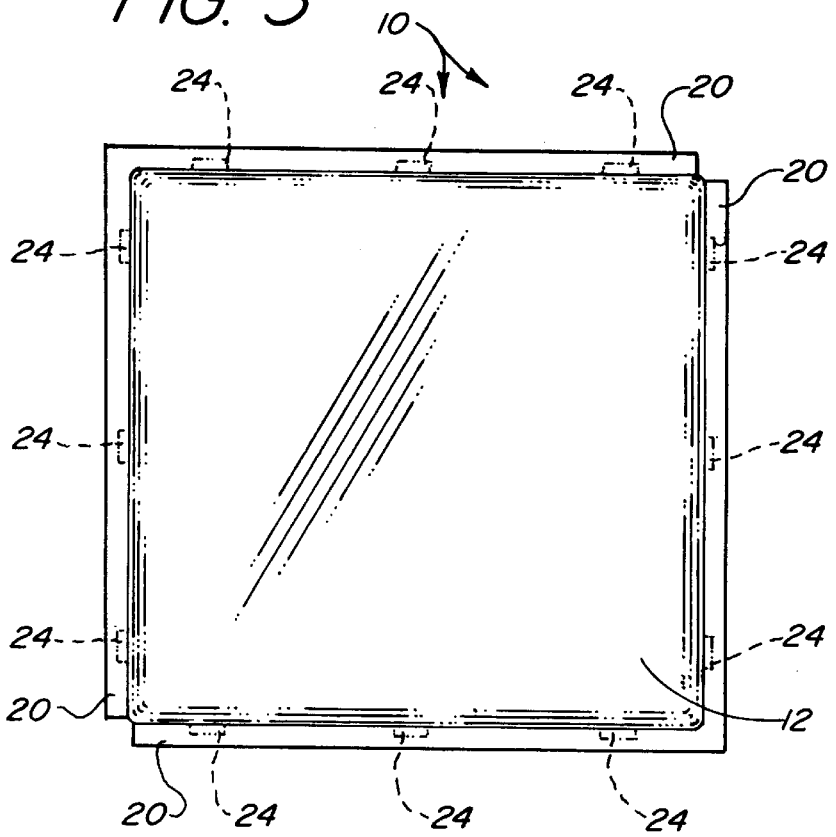
FIG. 3 is a front elevation view of the first construction block.
Figure 9:
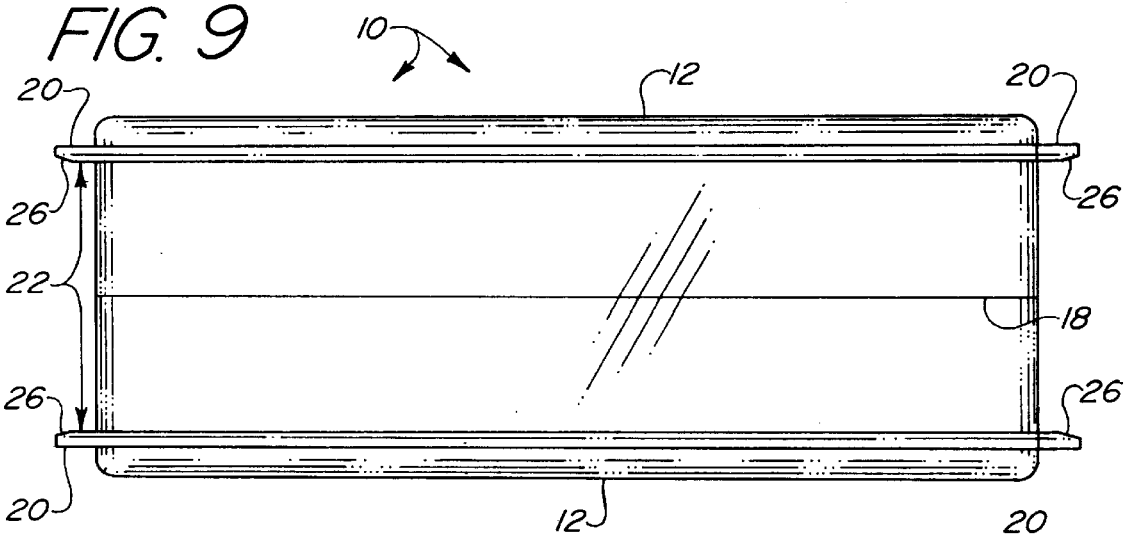
FIG. 9 is a side elevation view of the first construction block.
Figure 4:
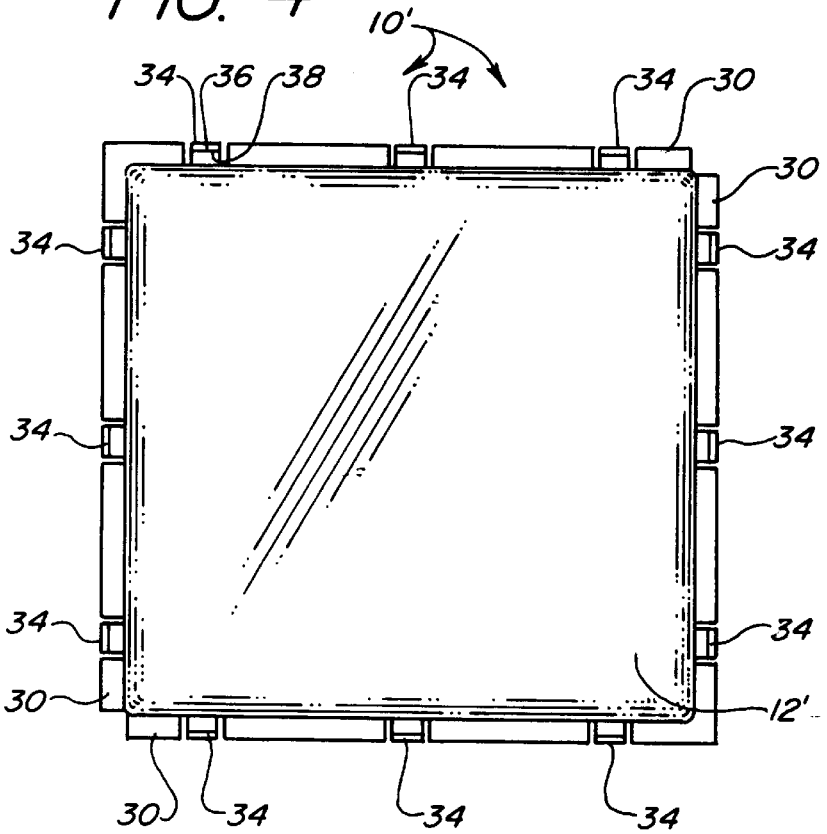
FIG. 4 is a front elevation view of the second construction block.
Figure 10:
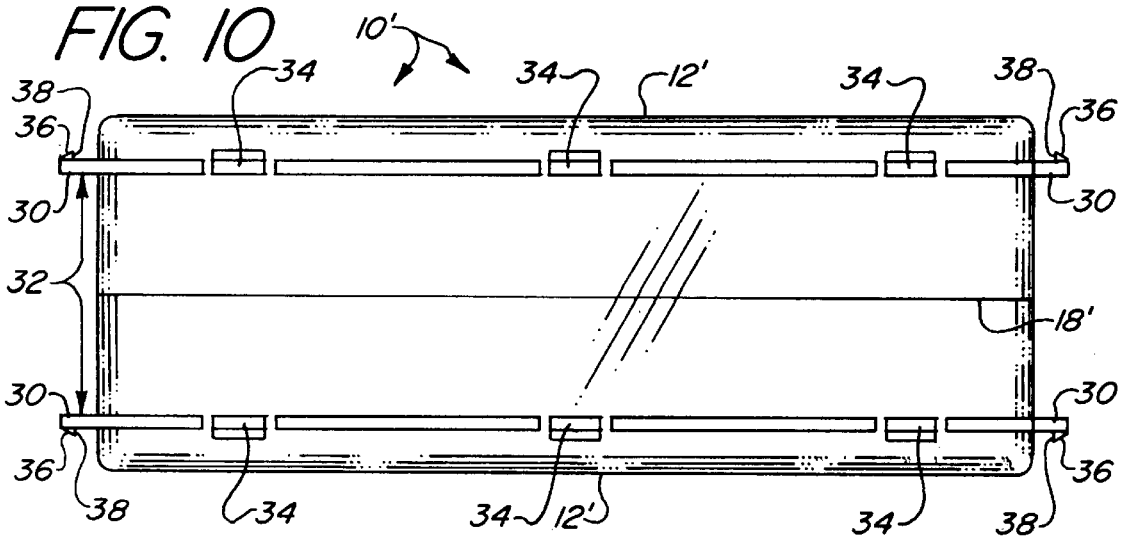
FIG. 10 is a side elevation view of the second construction block.
Figure 5:
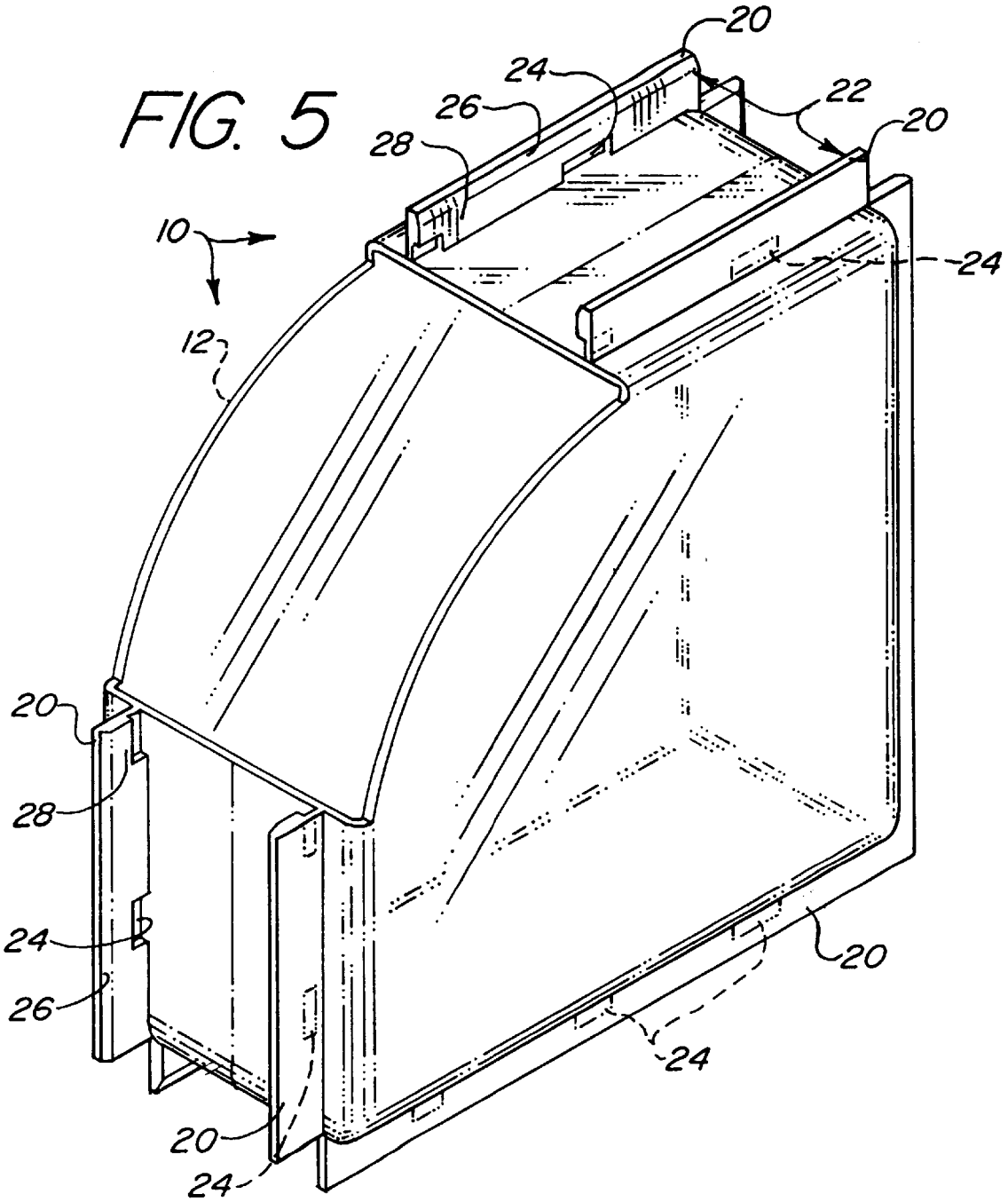
FIG. 5 is a perspective view of the first construction block with a section of the block removed.
Figure 7:
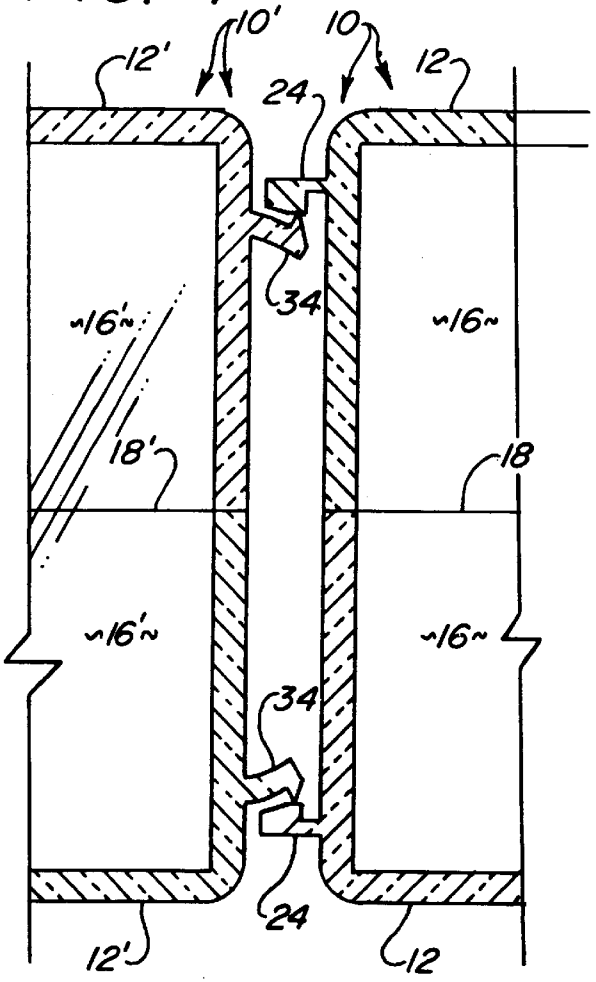
FIGS. 6–8 are cutaway views illustrating interconnection of the first construction block and the second construction block.
Figure 6:
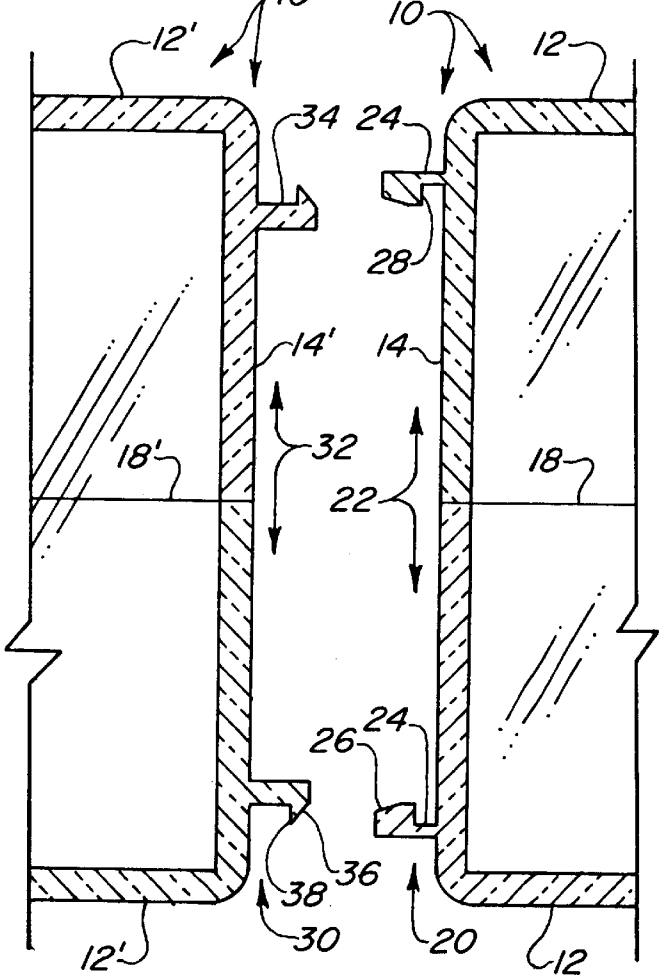

Referring now to the drawings, it is seen that the construction block system of the present invention is comprised of a first construction block 10, which is a generally rectangular form (although other geometric forms are possible) having a pair of parallel disposed faces 12 joined by four side edges 14, and a second construction block 10', which is also a generally rectangular form (although other geometric forms are possible) having a pair of parallel disposed faces 12 joined by four side edges 14. The first construction block 10 may be formed as a single unit, or as shown, as a pair of halves 16 joined along a seam 18 in any appropriate fashion. Similarly, the second construction block 10' may be formed as a single unit, or as shown, as a pair of halves 16' joined along a seam 18' in any appropriate fashion. Both the first construction block 10 and the second construction block 10' may be formed from any appropriate material such as glass, plastic, etc., and may be transparent, translucent, or opaque.

Located along the four side edges 14 of the first construction block 10 is a first set of spacing flanges 20 extending outwardly from the plane of the side edges 14. A first recess 22 exists between the first set of spacing flanges 20. By way of illustration, at least one hook receptacle 24 is located along the length of each of the first set of spacing flanges 20. As seen, each hook receptacle 24 has a ramped portion 26 and a lip 28. Located along the four side edges 14' of the second construction block 10' is a second set of spacing flanges 30. A second recess 32, which has a different distance relative to the first recess 22 existing between the first set of spacing flanges 20, exists between the second set of spacing flanges 30. By way of illustration, at least one hook 34 is along the length of each of the second set of spacing flanges 30. As seen, each hook 34 has a ramped portion 36 and a lip 38.

In order to interconnect the first construction block 10 with the second construction block 10', the two blocks are pushed together causing the ramped portion 36 of each hook 34 to interact with the ramped portion 26 of a corresponding hook receptacle 24. The hook 34 has sufficient resiliency to bend allowing the two ramped portions 26 and 36 to pass over one another. Once this occurs, the hook 34 "clicks" into place within the corresponding hook receptacle 24 and returns to its original shape. The lip 38 of the hook 34 abuts the lip 28 of the hook receptacle 24. The two lips 28 and 38 hold one another and prevent the blocks 10 and 10' from being separated. The overlapping first set of spacing flanges 20 and second set of spacing flanges 30 can be ultrasonically welded to one another to further secure the blocks 10 and 10' to each other. The outer faces of the first set of spacing flanges 20 form a grout groove. Furthermore, a structural bar 40 can be positioned within the second recess 32 of the second set of spacing flanges.

Figure 11:
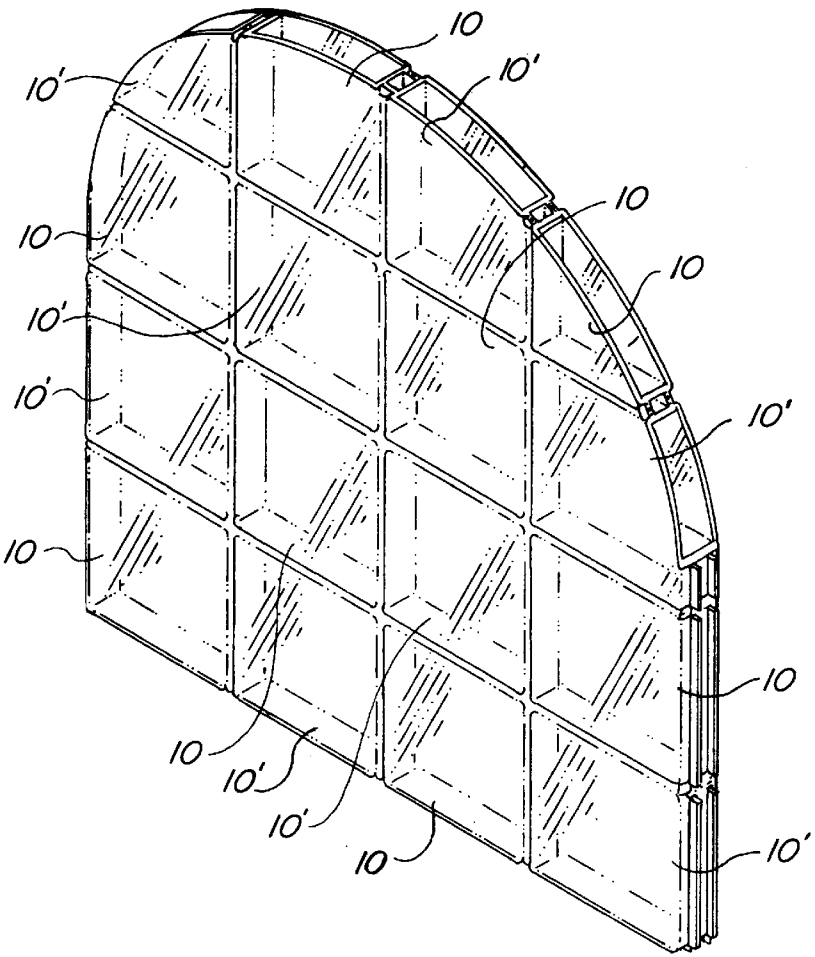
FIG. 11 is an example of a structure that can be constructed with the construction block system of the present invention.
Figure 8:
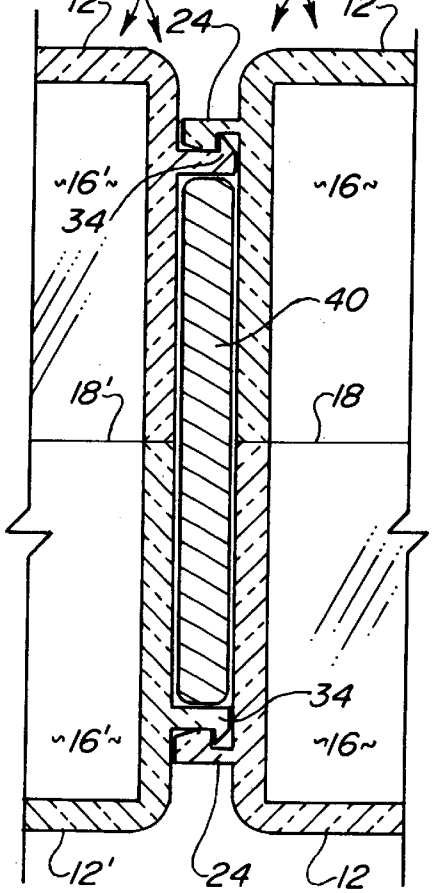

As seen in FIG. 11, an entire structure can be formed with the construction block system of the present invention such that each first construction block 10 is interconnected with one or more second construction blocks 10' in checker board fashion.

It is expressly understood, that the first set of spacing flanges 20 and the second set of spacing flanges can be reversed relative to the illustrations. Specifically, the first recess 22 of the first set of spacing flanges 20 would have a smaller distance relative to the second recess 32 of the second set of spacing flanges 30. In such an embodiment, the hook receptacles 24 would face away from each (as opposed to their facing each other as illustrated) and the ramped portions 36 of the hooks would be facing each other (as opposed to their facing away from each other as illustrated). The first construction block 10 and the second construction block 10' would interconnect in similar fashion. The structural bar 40, if used, would now be positioned within the first recess 22 of the first set of spacing flanges 20 and the outer faces of the second set of spacing flanges 30 would be used as a grout groove.

It is further expressly understood, that at least one hook 34 can be located along the first set of spacing flanges 20 (in addition to the hook receptacles 24) and corresponding hook receptacles 24 would be located along the second set of spacing flanges 30. The requirement of this mix and match hook receptacle 24 and hook 34 on both sets of spacing flanges 20 and 30 is that each hook on each of the construction blocks corresponds with a hook receptacle on the other construction block when the two blocks 10 and 10' are interconnected.

While the invention has been particularly shown and described with reference to an embodiment thereof, it will be appreciated by those skilled in the art that various changes in form and detail may be made without departing from the spirit and scope of the invention.

I claim:

1. A construction block system comprising, in combination:

a first body having a first pair of faces joined by a first side edge, a second side edge, a third side edge, and a fourth side edge;

a first set of spacing flanges, separated by a first distance, extending about the first side edge, the second side edge, the third side edge, and the fourth side edge;

at least one first hook receptacle located along the first set of spacing flanges;

a second body having a second pair of faces joined by a fifth side edge, a sixth side edge, a seventh side edge, and a eighth side edge;

a second set of spacing flanges, separated by a second distance which is different relative to the first distance, extending about the fifth side edge, the sixth side edge, the seventh side edge, and the eight side edge; and at least one first hook, located along the second set of spacing flanges, is received within a corresponding hook receptacle of the at least one first hook receptacle when the second rectangular body is interconnected with the first rectangular body.

2. The construction block system as in claim 1 wherein the first distance is greater than the second distance.

3. The construction block system as in claim 2 further comprising a structural bar positioned between the second set of spacing flanges when the first body is interconnected with the second body.

4. The construction block system as in claim 1 wherein the second distance is greater than the first distance.

5. The construction block system as in claim 4 further comprising a structural bar positioned between the first set of spacing flanges when the first body is interconnected with the second body.

6. The construction block system as in claim 1 wherein the first body and the second body are formed from translucent plastic.

7. The construction block system as in claim 1 wherein the first body and the second body are formed from transparent plastic.

8. The construction block system as in claim 1 wherein each of the at least one hook receptacle has a one way ramp.

9. The construction block system as in claim 1 wherein each of the at least one hook has a one way ramp.

10. The construction block system as in claim 1 wherein each of the at least one hook receptacle has a one way ramp and each of the at least one hook has a one way ramp.

11. The construction block system as in claim 1 further comprising:

at least one second hook receptacle located along the second set of spacing flanges;

at least one second hook, located along the first set of spacing flanges, adapted to be received within a corresponding hook receptacle of the at least one second hook receptacle when the first body is interconnected with the second body.

12. A construction block system comprising, in combination:

a first body having a first pair of faces joined by a first side edge, a second side edge, a third side edge, and a fourth side edge;

a first set of spacing flanges, separated by a first distance, extending about the first side edge, the second side edge, the third side edge, and the fourth side edge;

a second body having a second pair of faces joined by a fifth side edge, a sixth side edge, a seventh side edge, and an eighth side edge;

a second set of spacing flanges, separated by a second distance which is different relative to the first distance, extending about the fifth side edge, the sixth side edge, the seventh side edge, and the eight side edge; and attachment means, located along the first set of spacing flanges and the second set of spacing flanges, for holding the first body to the second body when the two are interconnected.

13. The construction block system as in claim 12 wherein the attachment means comprises:

at least one hook receptacle located along the first set of spacing flanges;

at least one hook, located along the second set of spacing flanges, is received within a corresponding hook receptacle of the at least one hook receptacle.

14. The construction block system as in claim 13 wherein the first distance is greater than the second distance.

15. The construction block system as in claim 14 further comprising a structural bar positioned between the second set of spacing flanges when the first body is interconnected with the second body.

16. The construction block system as in claim 13 wherein the second distance is greater than the first distance.

17. The construction block system as in claim 16 further comprising a structural bar positioned between the first set of spacing flanges when the first body is interconnected with the second body.

18. The construction block system as in claim 12 wherein the first body and the second body are formed from translucent plastic.

19. The construction block system as in claim 12 wherein the first body and the second body are is formed from transparent plastic.

20. The construction block system as in claim 13 wherein each of the at least one hook receptacle has a one way ramp.

21. The construction block system as in claim 13 wherein each of the at least one hook has a one way ramp.

22. The construction block system as in claim 13 wherein each of the at least one hook receptacle has a one way ramp and each of the at least one hook has a one way ramp.

23. The construction block as in claim 13 wherein the attachment means further comprises:

at least one second hook receptacle located along the second set of spacing flanges;

at least one second hook, located along the first set of spacing flanges, is received within a corresponding hook receptacle of the at least one second hook receptacle.

* * * * *